US009345088B2

(12) United States Patent
Sullivan

(10) Patent No.: US 9,345,088 B2
(45) Date of Patent: May 17, 2016

(54) LED CONTROL CIRCUITS AND METHODS

(71) Applicant: Texas Instruments Incorporated, Dallas, TX (US)

(72) Inventor: Timothy R. Sullivan, Longmont, CO (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 14/090,105

(22) Filed: Nov. 26, 2013

(65) Prior Publication Data

US 2014/0361699 A1 Dec. 11, 2014

Related U.S. Application Data

(60) Provisional application No. 61/832,613, filed on Jun. 7, 2013.

(51) Int. Cl.
*H05B 37/02* (2006.01)
*H05B 33/08* (2006.01)

(52) U.S. Cl.
CPC ..... *H05B 33/0845* (2013.01); *H05B 33/0815* (2013.01); *H05B 37/02* (2013.01)

(58) Field of Classification Search
CPC ..... H05B 33/0815; H05B 33/0827; H05B 37/02; H05B 41/36
USPC ..... 315/200 R, 219, 224–226, 287, 291, 315/294, 297, 307
See application file for complete search history.

(56) References Cited

U.S. PATENT DOCUMENTS

| | | | | |
|---|---|---|---|---|
| 8,525,438 | B1 * | 9/2013 | Cheung | H05B 33/0815 315/291 |
| 2008/0224629 | A1 | 9/2008 | Melanson | |
| 2008/0287092 | A1 | 11/2008 | Rindsberg et al. | |
| 2011/0285301 | A1 * | 11/2011 | Kuang et al. | 315/200 R |
| 2012/0181946 | A1 | 7/2012 | Melanson | |
| 2013/0147387 | A1 * | 6/2013 | Murdock | 315/247 |
| 2013/0300310 | A1 * | 11/2013 | Hu | 315/239 |

FOREIGN PATENT DOCUMENTS

WO WO2011061633 5/2011

OTHER PUBLICATIONS

PCT Search Report dated Jun. 9, 2014.

* cited by examiner

*Primary Examiner* — Tung X Le
(74) *Attorney, Agent, or Firm* — William B. Kempler; Frank D. Cimino

(57) ABSTRACT

An LED controller is disclosed herein. An embodiment of the controller includes a first input connectable to a power source and an output connectable to at least one light-emitting diode (LED). A power factor correction circuit is coupled between the first input and the output, wherein the power factor correction circuit operates in a first state when the power factor is corrected and wherein the power factor correction circuit operates in a second state when the power factor is not corrected. The power factor correction circuit is in the first state when no dimming of the LED is sensed, and the power factor correction circuit is in the second state when dimming of the LED is sensed.

20 Claims, 3 Drawing Sheets

LED CONTROL CIRCUITS AND METHODS

This application claims priority to U.S. provisional patent application 61/832,613 filed on Jun. 7, 2013 for DISABLING PFC (POWER FACTOR CORRECTION) CONTROL WHEN DIMMING IN AN LED LIGHTING APPLICATION WITH VARYING OUTPUT, which is incorporated for all that is disclosed.

BACKGROUND

Light-emitting diodes (LEDs) are becoming more prominent as replacements for conventional incandescent light bulbs. Ideally, an LED bulb directly replaces a conventional incandescent light bulb. For example, a user simply unscrews the conventional incandescent light bulb and replaces it with an LED bulb. The LEDs within the LED bulbs operate on direct current (DC) whereas the incandescent light bulbs operate on alternating current (AC), which presents some obstacles with direct replacements of incandescent light bulbs with LED bulbs.

One of the obstacles in replacing LED bulbs with incandescent light bulbs is dimming. Conventional dimmers for incandescent light bulbs do not work with LEDs. In order to obtain a dimming function without replacing the conventional dimmers, the LED bulbs need to have a controller that senses the dimming and outputs a DC current to the LEDs that is proportional to the dimming. This conversion presents problems with the power factor in LED bulbs. Ideally, the input current and input voltage should be in phase to achieve a high power factor. In order to achieve a high power factor in LED applications, a power factor correction circuit is used to provide DC current to the LEDs and keep the input AC voltage and current in phase.

In an ideal power factor correction circuit, the correction method is such that the input current is made to match the input voltage very closely. That places certain demands on how the output current driving the LEDs is drawn. In a simple LED driver, it is desirable for cost reasons to implement the AC to DC conversion in a single step. This means the LED current must also follow the input line voltage to achieve a high power factor.

In non-dimming applications, the LED current may follow the input tine voltage. However, in dimming applications, this relationship causes issues with components used in the dimmers, such as triacs. For example, power factor correction circuits and methods may cause compatibility problems, which cause the user to see flicker in the light output by the LED bulb.

DETAILED DESCRIPTION

Circuits and methods of controlling light-emitting diodes (LEDs) are disclosed herein. The LEDs are used in lighting applications where conventional dimmers are used. For example, a user may substitute a conventional incandescent light bulb with an LED bulb. If the LED bulb is connected to a dimmer, the circuits and methods disclosed herein enable the dimmer to operate and dim the LED bulb without producing flicker and other problems. The circuits and methods disclosed herein enable a high power factor by way of power factor correction when the LED bulb is not being dimmed. Power factor is not corrected when the LED is being dimmed.

Figure 1:
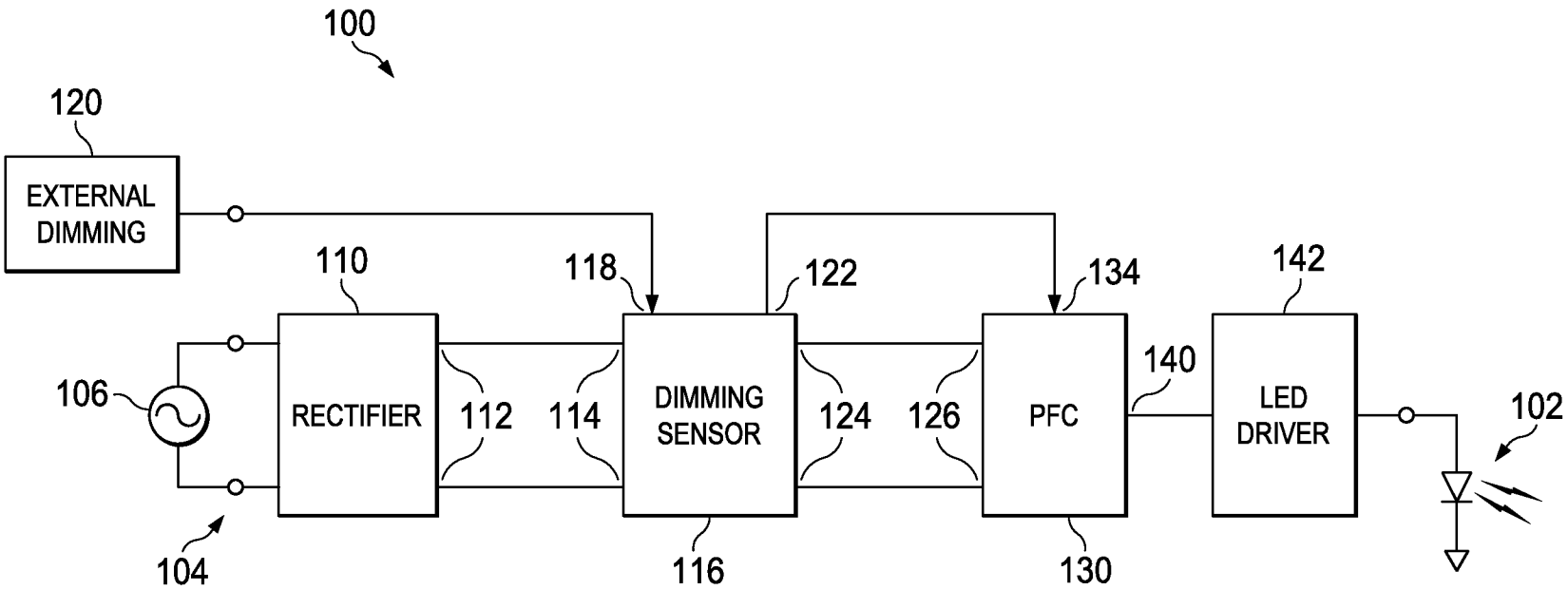
FIG. 1 is a block diagram of an embodiment of an LED controller.

A block diagram of an embodiment of a LED controller 100 is shown in FIG. 1. As described below, the LED controller 100 provides for power factor correction when a LED 102 is operating at full power or close to full power. When an input signal indicates that the LED 102 should operate at full power, the controller 100 does not dim the LED 102 connected to the controller 100. When the input signal indicates that the LED 102 is to be dimmed beyond a predetermined amount, the circuit 100 provides for the dimming of the LED 102.

The controller 100 has an input 104 that is connectable to an AC source 106. The AC source provides power for the LED 102. In some embodiments, the AC source 106 provides for dimming of the LED 102 by generating a clipped sine wave as described below. In the embodiment of FIG. 1, the input 104 is coupled to or connected to a rectifier 110, which may be a full wave rectifier. The rectifier 110 has an output 112 that is connected to or coupled to the input 114 of a dimming sensor 116. In the embodiment of FIG. 1, the dimming sensor 116 includes an input 118 that is sometimes referred to as a second input 118. The input 118 is connectable to an external dimming circuit 120. The external dimming circuit 120 provides dimming instructions or signals by means other than through the AC source 106. The dimming sensor 116 includes an output 122 that provides a signal indicating whether dimming is occurring as described in greater detail below.

The dimming circuit 116 has another output 124 that is connected to an input 126 of a power factor correction (PFC) circuit 130. The PFC circuit 130 has another input 134 that is connected to the output 122 of the dimming sensor 116. The status of a voltage or signal at the input 134 of the PFC circuit 130 enables the PFC circuit 130 to determine whether or not to apply power factor correction. As stated above, power factor correction is applied when the controller 100 is operating in a state where no or very little dimming of the LED 102 occurs. The PFC circuit 130 has an output 140 that is coupled to or connected to a LED driver 142. In some embodiments, the LED driver 142 provides current that is high enough to operate the LED 102. The LED driver 142 is connectable to the LED 102. The LED 102 is shown as being a single device; however, the LED 102 may be a plurality of LEDs mounted in a device that screws into a conventional light bulb socket. In some embodiments, other elements or circuits (not shown) may be connected between the PFC circuit 130 and the LED 102.

Having described the components of the controller 100, its operation will now be described. The following description relates to embodiments wherein the dimming signal is integrated with the AC source 106. More specifically, a triac or other device shapes the voltage output by the AC source 106, which determines the level of dimming. The AC source 106 originates from a conventional AC line voltage, such as a 120 v, 60 Hz source or a 220 v, 50 Hz source. Other embodiments wherein the dimming signal is input to the controller 100 by way of the external dimming circuit 120 are described further below.

Figure 2:
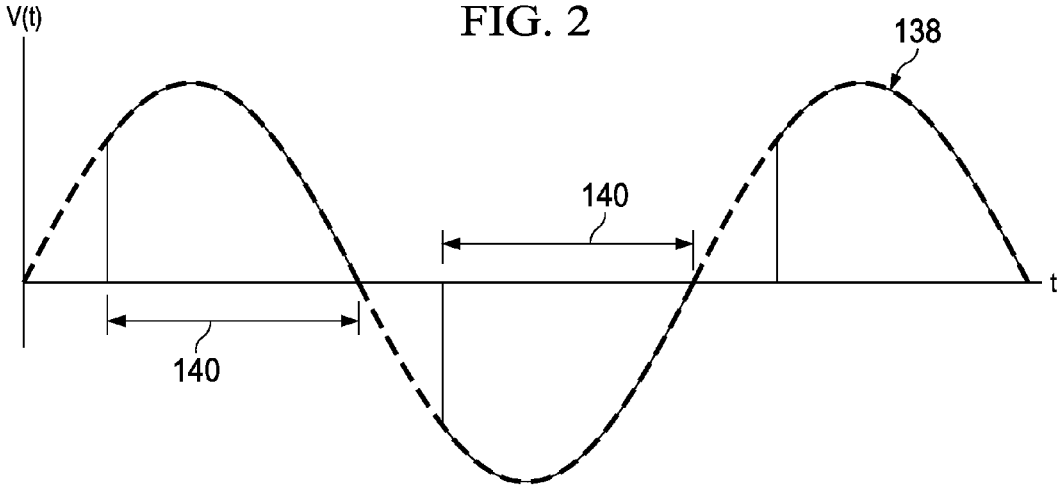
FIG. 2 is a graph of an embodiment of the input voltage to the LED controller of FIG. 1 during a dimming operation of the LED.

The AC source 106 provides for dimming of conventional incandescent light bulbs. The dimming operation is typically provided by a triac or other similar device or circuit that clips or cuts the sine wave of the AC source 106. Reference is made to FIG. 2, which shows a clipped sine wave 138 where dimming has been applied by a triac or other similar device. The clipped sine wave 138 is sometimes referred to as a phase cut sine wave. The dashed portions of the waveform in FIG. 2 show the sine wave 138 before the triac applied dimming to generate the clipped sine wave 138. The solid portions of the sine wave represent the dimmed signal output by the AC source 106. As shown by FIG. 2, the clipped sine wave 138 conducts for a phase 140, which is sometimes referred to as the conduction angle 140. By reducing the conduction angle 140, the power delivered to an incandescent light bulb is reduced, which results in dimming. Incandescent light bulbs have a long time constant, so a short conduction angle 140 typically does not result in flicker that a user can notice.

The LED 102 operates from a DC current source; otherwise, it would appear to flicker. LEDs have a very short time constant, so they only emit light during the period in which current flows. If the sine wave 138 was used to drive the LED 102, the short time constant of the LED 102 and the low frequency of the clipped sine wave 138 would produce flicker that a user would readily notice. In order to overcome this problem, the controller 100 uses the conduction angle 140 to determine the appropriate DC current flow through the LED 102. LED controllers use different embodiments of circuits to control the intensity of light emitted by the LED 102 wherein the light intensity is dependent on the conduction angle 140. For example, some LED controllers use various embodiments of flyback converters to control the current flow through the LED 102. Other embodiments use pulse with modulation to control the average intensity of light emitted by LEDs.

The PFC circuit 130 provides for power factor correction. In order to achieve high power factor, the PFC circuit 130 syncs the input voltage and the input current. Because the LED 102 is driven with a current from the AC source 106, the PFC circuit 130 syncs the output current with the input voltage. The output current may be measured at the input to the PFC circuit 130 or the input to the LED driver 142. When the controller 100 is providing for dimming of the LED 102, power factor correction may create problems with triacs and other devices used to provide dimming. Therefore, power factor correction is only activated during full power and is disabled during dimming.

In order to process the voltage from the AC source 106, the voltage is rectified by the rectifier 110. In the embodiment of FIG. 1, the rectifier 110 is a full wave rectifier that rectifies the voltage from the AC source 106, so that the conduction angle 140 is present in the rectified wave. An example of the rectified voltage that is phase cut is shown by the waveform 160 of FIG. 3. More specifically, the waveform 160 is the waveform that is generated by the rectifier 110. The waveform 160 has a period 162 and a conduction angle 164. The conduction angle 164 is the same or substantially the same as the conduction angle 140, FIG. 2.

The dimming sensor 116 analyzes the waveform 160 to determine if dimming has been applied at the AC source 106. In some embodiments, the dimming sensor 116 determines if dimming greater than a predetermined threshold has been applied. in other embodiments, the dimming sensor 116 determines if any dimming at all has been applied. In some embodiments, the dimming sensor 116 measures the period 162 of the waveform 160 and compares it to the period of the conduction angle 164. If the difference between the period 162 and the conduction angle 164 is greater than a predetermined value, the dimming sensor 116 determines that dimming is occurring. In some embodiments, the dimming sensor 116 determines that dimming is occurring if there is any difference between the period 162 and the conduction angle 164.

The waveform 160 is output by way of the output 124 to the input 126 of the PFC circuit 130. A signal indicative of the dimming state is transmitted from the output 122 of the dimming sensor 116 to the input 134 of the PFC circuit 130. The PFC circuit 130 monitors the input 134 to determine whether the LED 102 is to be dimmed. If the LED 102 is to be dimmed, the PFC circuit 130 disables power factor correction circuitry. If the LED 102 is not to be dimmed, the PFC circuit 130 activates power factor correction circuitry and drives the LED 102 so as maximize the power factor. For example, the current driving the LED 102 may be in phase with the voltage at the input 104. The current driving the LED 102 may be the current input to the PFC circuit 130 or the current input to the LED driver 142. Examples of PFC circuits and dimming sensors are disclosed in U.S. patent application Ser. No. 13/689,552.

The LED driver 142 generates a current that is suitable to drive the LED 102 and other LEDs (not shown) that may also be connected to the PFC circuit 130. In some embodiments, the LED driver 142 converts the waveform 160 to a DC current having a level that is proportional to the conduction angle 164.

Figure 3:
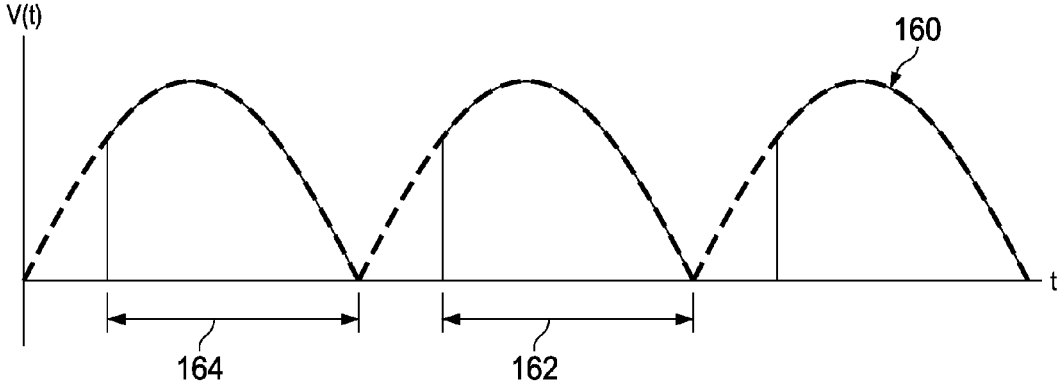
FIG. 3 is a graph of the rectified input voltage of FIG. 2.
Figure 4:
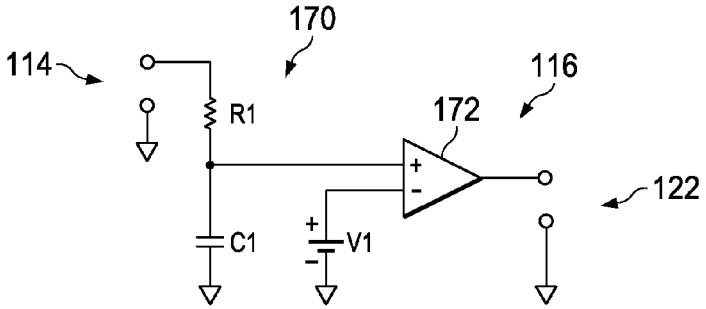
FIG. 4 is an embodiment of a dimming sensor of the block diagram of FIG. 1.

Various components of the circuit 100 are described in greater detail. below. Reference is made to FIG. 4, which is an embodiment of a portion of the dimming sensor 116. The dimming sensor 116 has a low-pass filter 170 connected to the input 114. The output of the low-pass filter 170 has a DC component that is representative of the conduction angle 164 of the phase cut waveform 160 as shown in FIG. 3. The output of the low-pass filter 170 is connected to an input of a comparator 172. The comparator 172 compares the voltage output by the low-pass filter 170 to a predetermined voltage V1. When no dimming is present, the waveform 160 has a long conduction angle 164, so the DC component is high, which causes the comparator 172 to generate an output voltage at the output 122. When the conduction angle 164 decreases, the DC component of the waveform 160 decreases to where it is less than the voltage V1. In this situation, the comparator 172 does not output a signal to the output 122. The PFC circuit 130 monitors the output 122 to determine if dimming is occurring and to enable or disable power factor correction as described above.

Other embodiments of the dimming sensor 116 may be used to determine whether dimming is occurring. In one embodiment, a first timer is operated during each cycle 160. A second timer operating at the same frequency as the first timer is operated during conduction angle 162 or 164. The results of the first timer and the second timer are compared. If the results are equal or within a predetermined value, dimming is not occurring and a signal to that effect is output on the output 122. If the result is greater than the predetermined value, dimming is occurring and a signal to that effect is output on the output 122.

Figure 5:
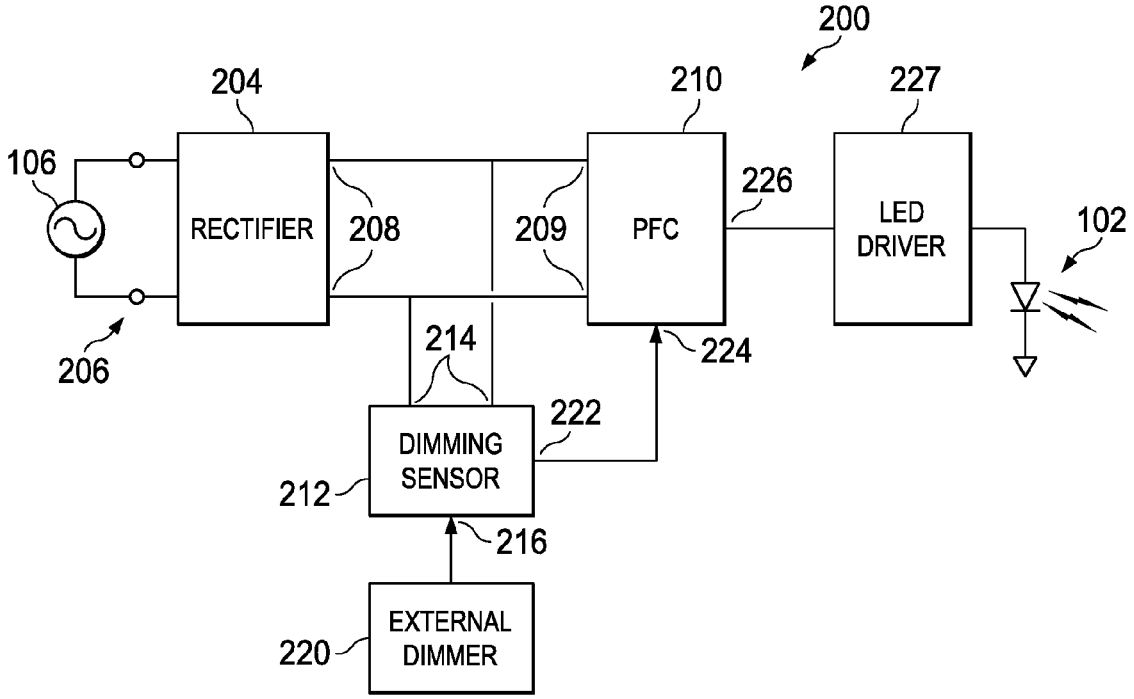
FIG. 5 is a block diagram of another embodiment of an LED controller.
Figure 6:
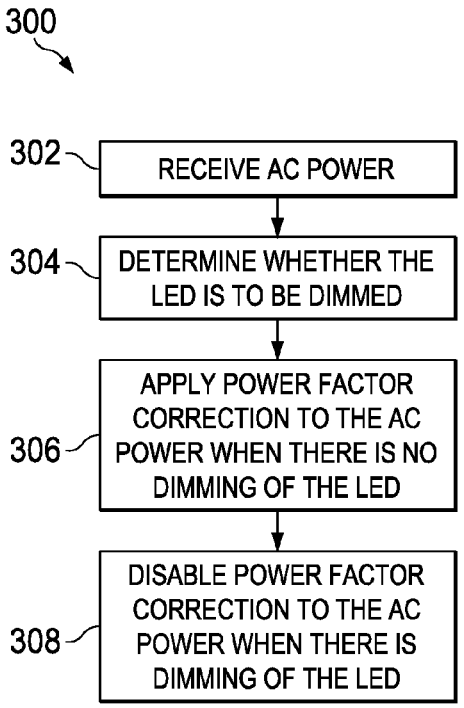
FIG. 6 is a flow chart describing the operation of the LED controllers of FIGS. 1 and 5.

Another embodiment of a LED controller 200 is shown in FIG. 5. The controller 200 includes a rectifier 204 that is connected to an input 206 to which the AC source 106 is connectable. The rectifier 204 has on output 208 that is connected to an input 209 of a PFC circuit 210. A dimming sensor 212 is also connected to the output 208 of the rectifier 204 by way of an input 214. The dimming sensor 212 has an input 216 that is connectable to an external dimmer 220. The dimming sensor 212 has an output 222 that is connected to an input 224 of the PFC circuit 210. The PFC circuit 210 has an output 226 that is connected to a LED driver 227. The output of the LED driver 227 is connectable to the LED 102.

The controller 200 differs from the controller 100, FIG. 1, in that the dimming sensor 212 monitors the voltage at the output 208 of the rectifier 204. Therefore, the voltage output by the rectifier 204 is received by the PFC circuit 210 without passing through the dimming sensor 212. All of the components of the controller 200 may be substantially similar or identical to the components of the controller 100 of FIG. 1.

Both controllers 100 and 200 have inputs for external dimmers 120 and 220. The external dimmers 120, 220 provide dimming through means other than the AC source 106. For example, the AC source may provide full power to the controllers 100, 200 and a separate control connected to the external dimmers 120, 220 provides the dimming commands. In some embodiments, the power factor correction is disabled when dimming occurs by way of the external dimmers 120, 220.

The operation of the controllers 100 and 200 is summarized by the flow chart 300 of FIG. 3. In block 302, AC power is received. With reference to the controller 200, the AC power 106 is received at the input 206. At step 304 a determination is made as to whether the LED is to be dimmed. With regard to the controller 200, the dimming sensor 212 determines whether the LED is to be dimmed. In step 306, power factor correction is applied to the AC power when there is no dimming of the LED. The controller 200 uses the PFC circuit 210 to apply power factor correction. In step 308, the power factor correction to the AC power is disabled when there is dimming of the LED.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. An LED controller comprising:

a first input connectable to a power source;

an output connectable to at least one light-emitting diode (LED);

a power factor correction circuit coupled between the first input and the output, wherein the power factor correction circuit operates in a first state where the power factor is corrected and wherein the power factor correction circuit operates in a second state where the power factor is not corrected, the power factor correction circuit being in the first state during an entire cycle of the power source when substantially no dimming of the LED is sensed, and the power factor correction circuit being in the second state when dimming of the LED is sensed.

2. The LED controller of claim 1 wherein dimming is sensed by monitoring the first input.

3. The LED controller of claim 1, wherein dimming is sensed by measuring a conduction angle on a voltage at the first input.

4. The LED controller of claim 1, wherein the first input is connectable to a dimmer.

5. The LED controller of claim 1 and further comprising a second input that is connectable to dimmer, and wherein the dimming is sensed by monitoring the second input.

6. The LED controller of claim 5, and further comprising a dimming sensor coupled to the second input, the dimming sensor sensing dimming at the second input and causing the power factor correction circuit to enter the first state when no dimming is sensed and the dimming circuit causing the power factor correction circuit to enter the second state when dimming is sensed.

7. The LED controller of claim 1, and further comprising a dimming sensor, the dimming sensor sensing dimming at the first input and causing the power factor correction circuit to enter the first state when no dimming is sensed and the dimming circuit causing the power factor correction circuit to enter the second state when dimming is sensed.

8. The LED controller of claim 7 wherein the dimming sensor measures a conduction angle on the voltage at the first input to sense dimming.

9. The LED controller of claim 1 and further comprising:

a rectifier coupled to the first input, the rectifier having an output, wherein the power factor correction circuit receives power from the output of the rectifier; and a dimming sensor coupled to the output of the rectifier, wherein the dimming sensor senses dimming.

10. A method of driving an LED, the method comprising:

receiving AC power from a power source at an input to a LED controller circuit;

determining whether the LED is to be dimmed;

providing a power factor correction circuit between the input and the LED;

operating a power factor correction circuit in the LED controller circuit in a first state by applying power factor correction to the AC power during an entire cycle of the AC power when there is substantially no dimming of the LED; and operating the power factor correction circuit in a second state by disabling power factor correction to the AC power when there is dimming of the LED.

11. The method of claim 10, wherein applying power factor correction includes applying power factor correction to the AC power when the dimming of the LED is greater than a predetermined level.

12. The method of claim 10, wherein determining whether the LED is to be dimmed includes monitoring the AC power.

13. The method of claim 10, wherein determining whether the LED is to be dimmed includes measuring a conduction angle on the AC power.

14. The method of claim 13, wherein determining whether the LED is to be dimmed further includes comparing the conduction angle to a predetermined value.

15. The method of claim 13, wherein determining whether the LED is to be dimmed further includes comparing the conduction angle to the period of the AC power.

16. The method of claim 10, wherein determining whether the LED is to be dimmed includes monitoring a signal output of a dimming device.

17. A method of driving an LED, the method comprising:

receiving AC power;

determining whether an LED is to be dimmed;

applying power factor correction to the AC power when there is substantially no dimming of the LED; and disabling power factor correction to the AC power when there is dimming of the LED, wherein determining whether the LED is to be dimmed includes operating a clock; counting clock pulses for the duration of a cycle of the AC power; counting clock pulses for the duration of a conduction angle; and comparing the number of pulses counted during the cycle of the AC power to the number of pulses counted during the conduction angle.

18. An LED controller comprising:

an first input connectable to a power source;

a rectifier coupled to the first input;

an output connectable to at least one light-emitting diode (LED);

a dimming sensor that senses if the LED is to be dimmed;

a power factor correction circuit coupled to the rectifier and the output, wherein the power factor correction circuit operates in a first state where the power factor is corrected and wherein the power factor correction circuit operates in a second state where the power factor is not corrected, the power factor correction circuit being in the first state during an entire cycle of the power source when substantially no dimming of the LED is sensed by the dimming sensor, and the power factor correction circuit being in the second state when dimming of the LED is sensed by the dimming sensor.

19. The circuit of claim 18, wherein the dimming sensor is coupled to the input and wherein the dimming sensor monitors the voltage of the input.

20. The circuit of claim 18 wherein the dimming sensor is connectable to a dimming device.

* * * * *